US006021337A

United States Patent [19]

Remillard et al.

[11] Patent Number: 6,021,337

[45] Date of Patent: Feb. 1, 2000

[54] STRIPLINE RESONATOR USING HIGH-TEMPERATURE SUPERCONDUCTOR COMPONENTS

[75] Inventors: Stephen K. Remillard, Arlington Heights; James D. Hodge, Lincolnwood, both of Ill.

[73] Assignee: Illinois Superconductor Corporation, Mt. Prospect, Ill.

[21] Appl. No.: 08/654,647

[22] Filed: May 29, 1996

[51] Int. Cl.[7] ..... H01P 7/08

[52] U.S. Cl. ..... 505/210; 505/700; 505/866; 333/99.005; 333/219; 333/238

[58] Field of Search ..... 333/995, 238, 333/219, 246, 222; 505/210, 700, 701, 866

[56] References Cited

U.S. PATENT DOCUMENTS

| | | | |
|---|---|---|---|
| 4,621,203 | 11/1986 | Sweeny . | |
| 4,837,536 | 6/1989 | Honjo | 333/99 S X |
| 4,869,598 | 9/1989 | McDonald | 374/176 |
| 4,918,050 | 4/1990 | Dworsky . | |
| 4,956,335 | 9/1990 | Agostinelli et al. . | |
| 5,164,358 | 11/1992 | Buck et al. | 505/210 X |
| 5,219,827 | 6/1993 | Higaki et al. | 505/210 X |
| 5,289,139 | 2/1994 | Fiedziuszko et al. | 331/56 |
| 5,309,119 | 5/1994 | Shiga | 331/99 |
| 5,340,797 | 8/1994 | Hodge et al. | 505/780 X |
| 5,373,109 | 12/1994 | Argyrakis et al. | 333/238 X |
| 5,378,949 | 1/1995 | Cummings et al. | 327/113 |
| 5,391,543 | 2/1995 | Higaki et al. | 505/210 |
| 5,397,769 | 3/1995 | Higaki et al. | 333/235 X |
| 5,418,504 | 5/1995 | Nottenburg | 333/238 X |
| 5,621,366 | 4/1997 | Gru et al. | 333/219 X |

FOREIGN PATENT DOCUMENTS 435765 7/1991 European Pat. Off. .

OTHER PUBLICATIONS

Apte et al., "Microwave Surface Resistance of high $T_c$ Superconducting Films", SPIE—The International Society for Optical Engineering, vol. 2559, pp. 92–104, Jul. 10, 1995.

Button et al., "The Processing and Properties of High $T_c$ Thick Films", University of Birmingham Superconductivity Research Group, Birmingham, B15 2TT, U.K., Sep. 24, 1990.

Chaloupka, H., "Theoretical and experimental characterization of nonlinear dynamic effects in epitaxial HTS microwave circuits and consequences to applications", Bergische Universität Wuppertal, FR Germany, Oct. 1991.

Fiory et al., "Penetration depths of high $T_c$ films measured by two–coil manual Inductances", *Appl. Phys. Lett.* 52(25):2165–2167 (1988).

Hein, Matthias A., "Microwave Properties of High–Temperature Superconductors: Surface Impedance, Circuits and Systems", External Report WUB 95–43 (1995), vol. 18, A. Narlikar Editor, (Nova Science Publishers, New York, 1996), p. 21.

(List continued on next page.)

*Primary Examiner*—Benny T. Lee
*Attorney, Agent, or Firm*—Marshall, O'Toole, Gerstein, Murray & Borun

[57] ABSTRACT

A stripline resonator has a center conductor between layers of dielectric which are, in turn, between ground planes. The center conductor is made of a high-temperature superconducting material, preferably having a total superconductor thickness from at least about one micron to at least about one-hundred microns. The superconducting material has an electromagnetic penetration depth and the ratio of the thickness of the superconductor to the penetration depth is from at least about 4:1 to at least about 100:1. The center conductor may be formed of a substrate coated with the high-temperature superconducting material so that the center conductor is discrete from the dielectric element. The center conductor may have a length which is greater than the length of the dielectric element.

51 Claims, 2 Drawing Sheets

OTHER PUBLICATIONS

Lancaster, M. J., "Passive Microwave Device Application of High Temperature Superconductors", Presented at the Institute of Physics conference on 'New materials and their applications' (Invited Paper) Apr. 10–12, 1990 at the University of Warwick, U.K. paper 2D.

Langley et al., "Magnetic penetration depth measurements of superconducting thin films by a microstrip resonator technique", *Rev. Sci. Instrum,* 62(7):1801–1812 (1991).

Liang et al., "High–Power HTS Microstrip Filters for Wireless Communication", *IEEE Transactions on Microwave Theory and Techniques,* 43(12):3020–3029 (1995).

Mannhart et al., "High–$T_c$ Thin Films. Growth Modes—Structure—Applications", Invited presentation at NATO ASI Course on "Materials and Crystallographic Aspects of High $T_c$ Superconductivity", Erice, Italy, May 17–29, 1993.

Mossavati et al., "Thick film YBCO microstrip resonators", *Supercond. Sci. Technol.,* 4:S145–S147 (1991).

Oates et al., "Measurements and Modeling of Linear and Nonlinear Effects in Striplines", Published in *Journal of Superconductivity,* 5(4):361–369 (1992).

Oates et al., "Surface Impedance Measurements of $YBa_2Cu_3O_{7-x}$ Thin Films In Stripline Resonators", *IEEE Transactions on Magnetics,* 27(2):867–871 (1991).

Orlando et al., "Foundations of Applied Superconductivity", Copyright® 1991 by Addison–Wesley Publishing Company, Inc., pp. 368–383.

Pond et al., "$YBa_2Cu_3O_{7-\delta}$/$LaA10_3$/$YBa_2Cu_3O_{7-\delta}$ TriLayer Transmission Lines for Measuring the Superconducting Penetration Depth", *IEEE Transactions On Applied Superconductivity,* 3(1):1438–1441 (1993).

Remillard et al., "The microwave surface impedance of granular high $T_c$ superconductors in dc magnetic fields: its relationship to frequency dependence", *J. Appl. Phys.,* 75(8):4103–4108 (1994).

Shen, Zhi–Yuan, "High–Temperature Superconducting Microwave Circuits", ® 1994 Artech House, Inc., pp. 28–29.

Shen, Zhi–Yuan, "High–Temperature Superconducting Microwave Circuits", ® 1994 Artech House, Inc., pp. 46–57.

Shen, Zhi–Yuan, "High–Temperature Superconducting Microwave Circuits", ® 1994 Artech House, Inc., Chapter 4, *Passive Components,* pp. 103–145.

Shields et al., "Thick films of YBCO on alumina substrates with zirconia barrier layers", *Supercond. Sci. Technol.* 5:627–633 (1992).

Stoessel et al., "Thin–Film Processing of High–$T_c$ Superconductors", *Journal of Superconductivity,* 6(1):1–17 (1993).

Talisa et al., "Dynamic Range Considerations for High–Temperature Superconducting Filter Applications to Receiver Front–Ends", *IEEE Microwave Symposium Digest*, pp. 1–4 (1994).

Withers et al., "Passive Microwave Devices and Their Applications", H. Weinstock and R. W. Ralston (eds.), *The New Superconducting Electronics,* pp. 277–310, ® 1993 Kluwer Academic Publishers.

Communication Relating to the Results of the Partial International Search, Annex to Form PCT/ISA/206, for International Application No. PCT/US97/08839, mailed Sep. 16, 1997.

Fathy et al., "Critical Design Issues in Implementing a YBCO Superconductor—Band Narrow Bandpass Filter Operating at 77K," *IEEE MTT–S International Microwave Symposium Digest,* vol. III, pp. 1329–1332, (1991).

Mao et al., "Propagation Characteristics of Superconducting Microstrip Lines," *IEEE Transactions on Microwave Theory and Techniques,* vol. 44, No. 1, pp. 33–40, (Jan. 1996).

Mossavati et al., "Thick Film YBCO Microstrip Resonators," *IEEE Transactions on Magnetics,* vol. 27, No. 2, pp. 2952–2954, (Mar. 1991).

Porjesz et al., "Magnetic Field Controlled Superconducting Microwave Microstrip Resonators," *Applied Superconductivity,* vol. 1, Nos. 10–12, pp. 1707–1713, (1993).

Wu et al., "Characteristics and growth of single crystals of $Y_1Ba_2Cu_3O_7$ with superior microwave properties," *Applied Physics Letters,* vol. 55, No. 7, pp. 696–698, (Aug. 1989).

Zahopoulos et al., "Performance of a high $T_c$ superconducting ultralow–loss microwave stripline filter," *Applied Physics Letters,* vol. 58, No. 9, pp. 977–979, (Mar. 1991).

FIG. 1
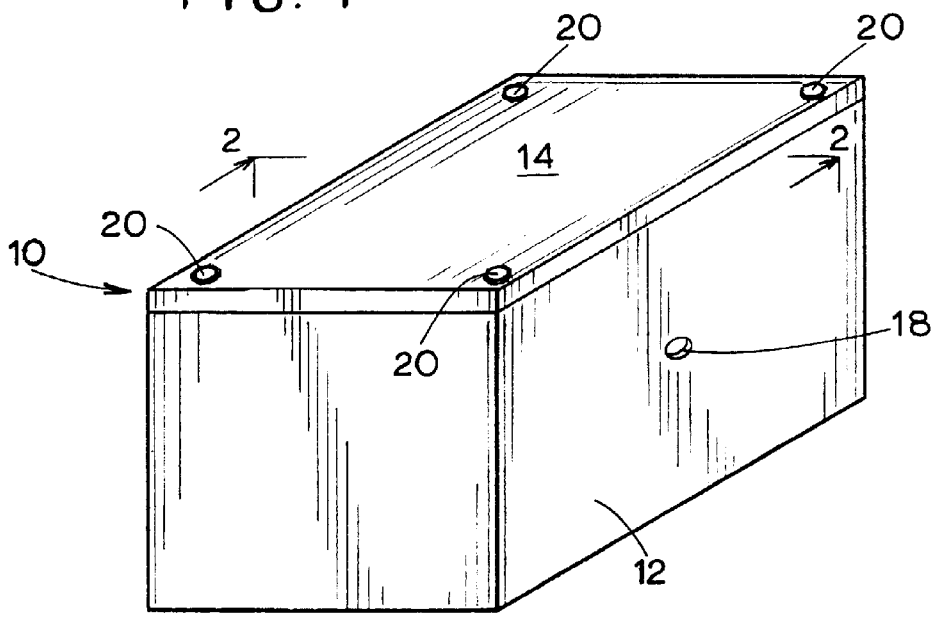
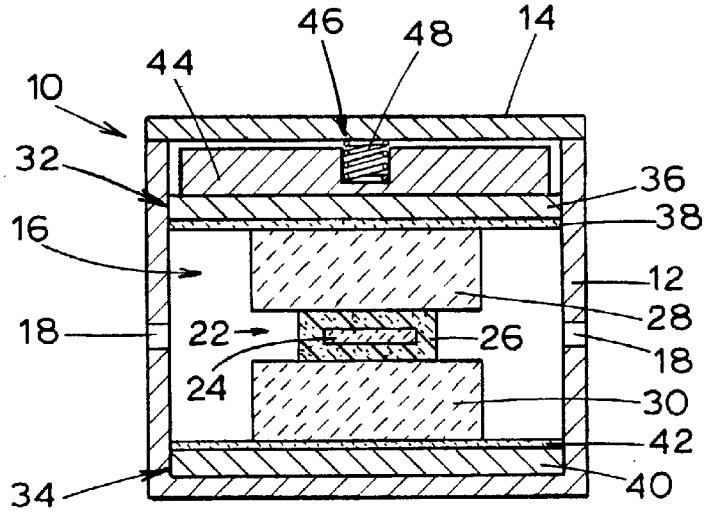
FIG. 2

STRIPLINE RESONATOR USING HIGH-TEMPERATURE SUPERCONDUCTOR COMPONENTS

This invention was made with government support under an Advanced Technology Program grant awarded by the United States Department of Commerce.

FIELD OF THE INVENTION

The present invention relates generally to stripline electromagnetic resonators, and more particularly to stripline resonators utilizing high-temperature superconductor components.

BACKGROUND OF THE INVENTION

Stripline electromagnetic resonators consist of a center conductor sandwiched between two dielectric slabs. Outer surfaces of the dielectric slabs are in contact with ground planes which are conventionally made of metal. The center conductor, which is also conventionally a metal, as a length chosen to correspond with a fraction (approximately ½, ¼, or ⅛) of the wavelength of the desired resonant frequency in the dielectric elements. Signals are coupled to and from the resonator using coupling mechanisms located laterally from the center conductor.

Recently, high-temperature superconducting materials have been used in electromagnetic resonators because of their low electrical surface resistance when cooled to below their critical temperatures. In the case of stripline resonators, the focus has been on the use of so-called thin film, high-temperature superconductors as both a material for the center conductor and the ground planes. Thin films are generally epitaxial, in which a single crystal of the high-temperature superconducting material is grown on a substrate. Thin film superconductors may have a thickness of about one micron but are usually only about 0.5 micron thick, after which they loose their epitaxy, and hence their desirable electromagnetic properties. Mannhart, J. et al., "High-$T_C$ Films, Growth Modes—Structure—Applications," NATO ASI Course on "*Materials and Crystallographic Aspects of High $T_c$ Superconductivity*" (1993 preprint).

The substrate in a thin film stripline resonator is chosen for its crystalline structure and serves as a template for the formation of the superconducting thin film. The crystalline structure of the substrate can be a limiting factor in the design of stripline filters because the substrate usually also serves as one of the dielectric slabs. A dielectric that has a suitable crystalline structure may not have a sufficiently high dielectric constant, or may have too high a dielectric loss, to be suitable as a dielectric element in a stripline filter. In addition, substrates must be chosen to minimize any chemical reaction between the superconductor and the substrate so that no undesirable reaction layer is formed between the superconductor and the substrate.

Another disadvantage of thin film superconductors is their relatively low ratio of the thickness of the film to electromagnetic penetration depth. The penetration depth is the depth below the surface of a superconductor at which an electromagnetic field external to the superconductor has been decreased by a factor of e (approximately 0.37). Penetration depth is temperature-dependent, with the smallest penetration depth for a material at 0 K. Penetration depth of superconductors can be determined for various temperatures using the formula $\lambda_T=\lambda_0/(1-(T/T_c)^4)^{1/2}$, where T is the temperature in Kelvin, $\lambda_T$ is the penetration depth at T, $\lambda_0$ is the penetration depth at 0 K, and $T_c$ is the critical temperature of the superconductor. Shen, Z. Y., *High Temperature Superconducting Microwave Circuits*, Section 2.4.2, p. 29 (Artech House 1994). As used herein, penetration depth is measured at 77 K, which is the temperature at which many high-temperature superconductor devices are expected to operate. See, Apte, P. R. et al., "Microwave Surface Resistance of High $T_c$ Superconducting Films," *High-Temperature Microwave Superconductors and Applications, Proc. SPIE*, Vol. 2559, pp. 92–104, (Jul. 10, 1995). The strength of the field in a superconductor decreases exponentially so that some small amount of the field will penetrate through a thin film of superconducting material. With increased field penetration, the nonlinear power response increases, which, in turn, leads to increased distortion at higher powers or field strengths. See, Shen, Z. Y., *High Temperature Superconducting Microwave Circuits*, Section 2.8, pp. 47–57 (Artech House 1994). For instance, nonlinear responses at higher powers include excessive losses at the resonant frequency and increased intermodulation distortion (where signals at unwanted frequencies are produced from the interaction between two or more input signals).

Thin film superconductors exhibit a generally small penetration depth, as little as about 0.25 micron at 77 K. See Oates, D. E., "Surface Impedance Measurements of $YBa_2Cu_3O_{7-x}$ Thin Films in Stripline Resonators" *IEEE Transactions on Magnetics*, Vol. 27, pp. 867–871 (1991) (finding penetration depths of 0.167 micron at 4.2 K, which leads to a 0.275 micron penetration depth at 77 K). The small thickness of such films means that the ratio of thickness to penetration depth is at most 4:1 (when the film is one micron thick), but will usually be less than about 2:1 (when the film is less than 0.5 micron thick). In the case of a stripline resonator, the center conductor is subjected to magnetic fields both from its top and from its bottom so that its effective thickness for the purpose of comparison with penetration depth is only half the overall thickness of the thin film. With the thickness of the film effectively halved, the ratio of thickness to penetration depth for thin film stripline center conductors is only approximately 2:1 to 1:1. Thin film superconductors often exhibit a nonlinear power response (see Oates, D. E. et al., "Measurements and Modeling of Linear and Nonlinear Effects in Striplines", *Journal of Superconductivity*, Volume 5, pp. 361–369, August 1992), which may be caused by such a small thickness to penetration depth ratio.

SUMMARY OF THE INVENTION

In accordance with one aspect of the present invention, a superconducting stripline resonator has a dielectric element with a first side and a second side. A first ground plane is adjacent the first side of the dielectric element, and a second ground plane is adjacent the second side of the dielectric element. A center conductor is located in the dielectric element and may be comprised of a thick film of high-temperature superconducting material having a thickness of at least about one micron.

The dielectric element may comprise two dielectric slabs. The dielectric element has a length and the center conductor has a length, and the length of the center conductor may be greater than the length of the dielectric element. The first ground plane and the second ground plane may be comprised of substrates with coatings of high-temperature superconductor. The center conductor may also be a substrate with a coating of high-temperature superconducting material. The superconducting material in the center conductor may preferably have a total thickness of at least about two microns, more preferably of at least about five microns, still more preferably at least about ten microns, and most preferably at least about one-hundred microns. The superconducting material in the center conductor may have a penetration depth and may have a thickness at least about twice the penetration depth, more preferably at least about four times the penetration depth, still more preferably at least about twenty times the penetration depth, yet more preferably at least about fifty times the penetration depth, and most preferably at least about one-hundred times the penetration depth.

The center conductor may have two sides and electromagnetic fields may be present on each of the two sides. The superconducting material may have a thickness of at least about 0.5 micron, more preferably at least about one micron, more preferably at least about five microns, still more preferably at least about ten microns, and most preferably at least about fifty microns on each side of the center conductor.

The thickness of superconducting material on each side of the center conductor is at least about twice, more preferably at least about ten times, and most preferably at least about fifty times the penetration depth of the superconducting material.

Other features and advantages are inherent in the stripline resonator claimed and disclosed or will become apparent to those skilled in the art from the following detailed description in conjunction with the accompanying drawings.

BRIEF DESCRIPTION OF THE DRAWINGS

FIG. 1 is a perspective view of a housing containing a stripline resonator of the present invention;

FIG. 2 is a sectional view of the housing and stripline resonator of FIG. 1 taken along the line 2—2 in FIG. 1.

DETAILED DESCRIPTION OF THE PREFERRED EMBODIMENT

Figure 3:
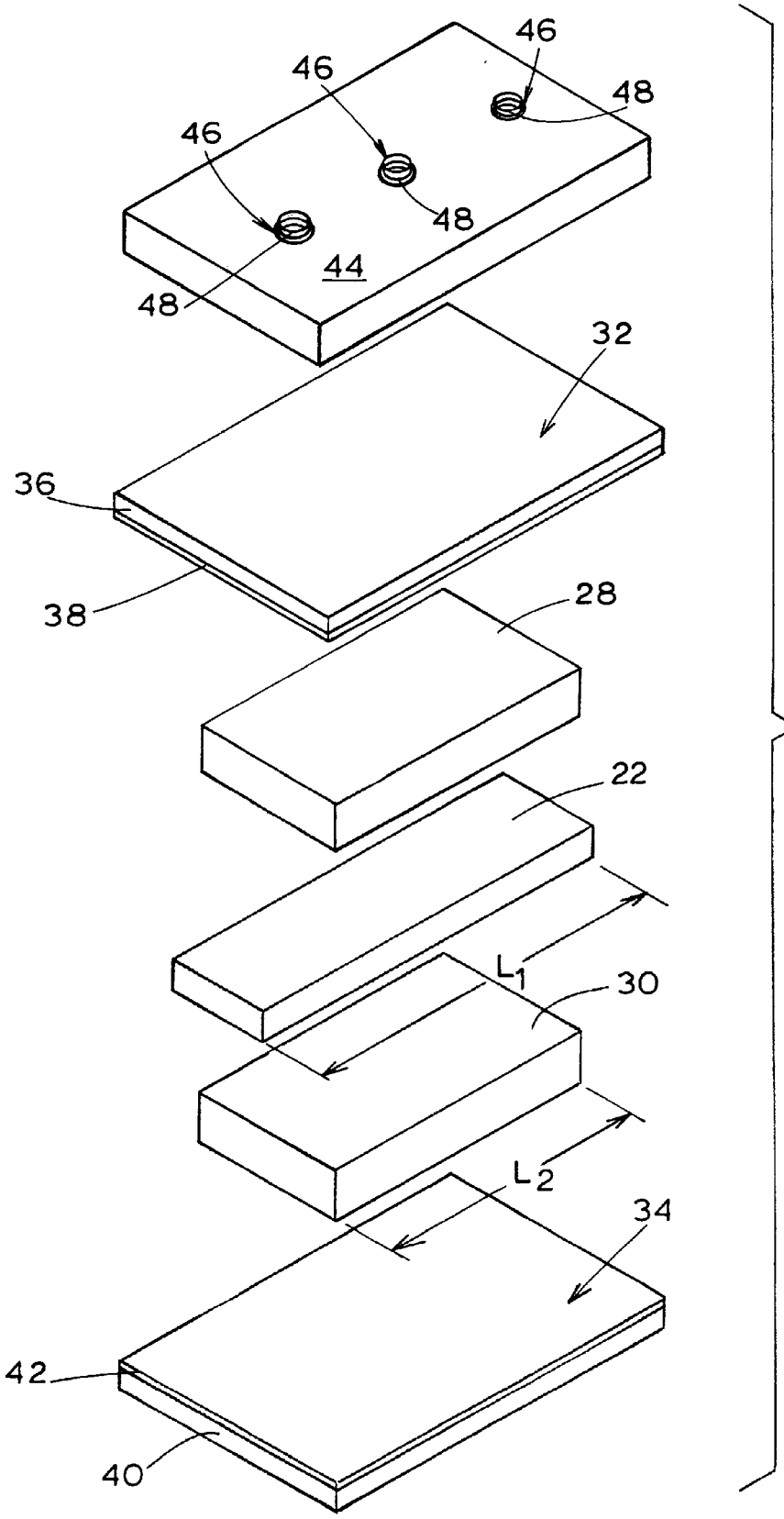
FIG. 3 is an exploded perspective view of a stripline resonator of the present invention.

Referring initially to FIGS. 1 and 2, a housing indicated generally at 10 has a base 12 and a cover 14. As seen in FIG. 2, the housing 10 contains a stripline resonator indicated generally at 16. The walls of the base 12 have openings 18 (also depicted in FIG. 1) through which a device such as a coupling loop (not depicted) may pass in order to transmit signals to or from the resonator 16. Several bolts 20 (FIG. 1) secure the cover 14 to the base 12.

Referring now to FIGS. 2 and 3, the resonator 16 includes a center conductor indicated generally at 22 having a substrate 24 with a coating 26 of high-temperature superconducting material (FIG. 2). The center conductor 22 is in slab or bar form but could be of a different shape such as a rod, disc, spiral, ring, hairpin, etc. The center conductor 22 is sandwiched between an upper dielectric slab 28 and a lower dielectric slab 30. Although two discrete dielectric slabs 28 and 30 are shown in FIGS. 2 and 3, they could be combined into a single dielectric element having an opening or recess for receiving the center conductor 22. The dielectric slabs 28 and 30 are in turn sandwiched by an upper ground plane indicated generally at 32 and a lower ground plane indicated generally at 34. The upper ground plane 32 consists of a substrate 36 with a coating 38 of high-temperature superconducting material on its lower surface. Similarly, lower ground plane 34 includes a substrate 40 with a coating 42 of high-temperature superconducting material on its upper surface. Above the upper ground plane 32 is a plate 44 having three recesses 46 (best seen in FIG. 3 but also shown in FIG. 2). Inside the recesses 46 are springs 48 which engage the cover 14 (best seen in FIG. 2 but also shown in FIG. 3). The force exerted by the springs 48 through the plate 44 onto the components of the resonator 16 reduces movement and insures maximum contact between the respective surfaces of the resonator components. Absent such a force by springs 48 (or similar confining pressures), air gaps may be present between adjacent resonator components resulting in losses at the resonant frequency.

Although only a single resonator is shown in FIGS. 1–3, two or more resonators can be connected together to form a filter. The specific dimensions of each component of each resonator will be determined by the desired filtering characteristics of such a filter, as is known in the art.

As seen in FIG. 3, the center conductor 22 has a length $L_1$, and the lower dielectric slab 30 has a length $L_2$. The upper dielectric slab 28 may also have a length $L_2$. $L_1$ is larger than $L_2$ so that the ends of the center conductor 22 extend beyond the ends of the dielectric slabs 28 and 30 and are isolated from the surrounding structure. Providing a center conductor with a length greater than the dielectric slab has several advantages over conventional stripline resonator designs in which the entire center conductor is covered above and below by dielectric. First, in creating the center conductor 22, the coating 26 on the substrate 24 may be processed by heating to melt-texture the superconducting material in the coating 26. During such processing, if the center conductor is held in place by a stand or other structure, the superconducting material may not be properly textured in the area where that material is in contact with a stand. By lengthening the center conductor 22, it can be held during processing at its ends so that any damaged superconductor coating will not be adjacent the high-electromagnetic field energy regions in the resonator 16 between the upper dielectric slab 28 and the lower dielectric slab 30. Second, any damaged superconducting material will not be in contact with the upper dielectric slab 28 or the lower dielectric slab 30 so that maximum physical contact can be achieved between the center conductor 22 and the dielectric, eliminating air pockets in the resonator. Finally, lengthening the center conductor 22 permits shortening of the dielectric slabs 28 and 30. For instance, a stripline resonator having a center conductor 5 cm in length and sapphire dielectric slabs 7.6 cm by 2.54 cm by 0.64 cm, has a predicted frequency range of 880 to 950 megahertz depending on any tuning of the resonator. If the center conductor is lengthened to 6 centimeters, the sapphire length may be decreased to 5.1 cm in order to obtain a resonator with the same predicted frequency range. Moreover, decreasing the amount of dielectric used is desirable because it reduces the cost of one of the more expensive components of the resonator.

The housing 10 (FIGS. 1 and 2) can be made of any suitably sturdy material having a conducting or superconducting surface, but is preferably made from a conductor such as copper or silver-plated aluminum or brass. The substrates 36 and 40 (FIGS. 2 and 3) may be made of a conductor in order to provide good electrical contact between the ground planes 32, 34 (FIGS. 2 and 3) and the housing 10/electrical ground. The coatings 38 and 42 (FIGS. 2 and 3) are preferably a thick film of high-temperature superconductor, which can be applied by any known method. If the superconductor coating is $YBa_2Cu_3O_{7-x}$, it can be applied in accordance with the teachings of U.S. Pat. No. 5,340,797, which is incorporated herein by reference. If the method of U.S. Pat. No. 5,340,797 is used, the substrates 36 and 40 (FIGS. 2 and 3) will be metal made of, or coated with, silver prior to coating with the superconductor. A variety of dielectric materials can be used for dielectric slabs 28 and 30 including (Ba, Pb) $NdTi^5O_{14}$, (Zr, Sn)$TiO_4$, Ba(Zr, ZnTa)$O_3$, rutile, polycrystalline alumina, such as General Electric's Lucalox®polycrystalline alumina, and sapphire. Sapphire is most preferable because of its low dielectric loss at and below the critical temperature (92 K) of many high-temperature superconductors. Sapphire is not normally used with thin film processes because it does not have the proper crystalline structure to provide optimum epitaxial growth in the superconductor, and may also form an undesirable reaction layer during processing. A significant advantage of the present invention, therefore, is that it permits use of sapphire in a superconducting stripline resonator.

The center conductor 22 or the ground planes 32 and 34 may also be manufactured by using the following method with a variety of substrates including, zirconia, magnesia or titanates. To manufacture one kilogram of the superconductor coating, 640.6 grams of barium carbonate, 387.4 grams of cupric oxide, and 183.2 grams of yttrium oxide are dried and mixed together with zirconia grinding beads and 500 milliliters of absolute ethanol. The mixture is then vibramilled for 4 hours, dried, sieved, and freeze-dried for 12 hours. The powder is transferred to alumina boats and placed in a calcination furnace where the temperature is raised 10° C. per minute to 860° C. where it remains for 16 hours. The furnace is then cooled at 50° C. per minute to room temperature. The calcined powder is vibramilled for 16 hours, rotary evaporated, sieved, and freeze-dried for 12 additional hours.

A vehicle, to be mixed with the superconductor powder to form a coating ink, is made using ingredients in the following weight percents:

| | |
|---|---|
| Terpineol | 43.6% |
| 2-(2-Butoxy) Ethyl-Acetate (BCA) | 43.6% |
| Paraloid B-67 | 5.73% |
| Ehec-Hi Cellulose | 2.12% |
| T-200 Cellulose | 2.35% |
| N-4 Cellulose | 2.6% |

The Paraloid™ B-67 acrylic copolymer is dissolved in the terpineol and 2-(2-Butoxy Ethyl-Acetate (BCA) with a magnetic stirrer for 24 hours. The remaining ingredients are mixed together and slowly added to the solvent mixture and then left to dissolve while stirring for 12 hours.

The powder is then hand mixed with the vehicle on an alumina plate, 20% vehicle by weight to 80% powder. The vehicle-powder mixture is milled on a three-roll mill with the gap between the back rollers set at 0.01 inches and the front rollers set at 0.001 inches. Each ink is passed through the mill rollers three times and then left to stand for 24 hours. Ink is applied to the substrates using any conventional coating method including dipping, doctor blading, and screen printing.

In order to obtain the desired microstructure, the superconductor coating is melt-textured in a furnace having an oxygen atmosphere at about 760 torr. The furnace is heated from room temperature at about 10° C. per minute to about 1050° C. The furnace remains at 1050° C. for six minutes and then is cooled at about 2° C. per minute to room temperature. Although substrates are preferably used for manufacturing the center conductor 22 and the ground planes 32 and 34, they can each be made from bulk or sintered superconductor materials having a desirable microstructure.

The stripline resonator of the present invention has significant advantages over conventional thin film superconducting stripline resonators. First, a thick film may have up to approximately fifty microns of high-quality superconducting material. While the actual thickness of the coating may be greater than fifty microns, the melt texturing is likely to produce only a fifty micron layer of superconductor having a desirable microstructure and low surface resistance. The penetration depth at 77 K of the quality layer of thick film superconductor will be approximately 0.5 to one micron. See, Remillard, S. K., "The Microwave Surface Impedance of Granular High $T_c$ Superconductors in DC Magnetic Fields: Its Relationship to Frequency Dependence," *J. Appl. Phys.*, Vol. 75(8), pp. 4103–4108, April 1994. Thick films, therefore, are in one sense less desirable than thin films because thin films may have a penetration depth of as little as about 0.25 micron at 77 K. However, thick films may have a significantly thicker layer of superconductor so that the ratio of thickness to penetration depth may be preferable for certain thick films. For instance, if a film is one-hundred microns thick (fifty microns on each side of a substrate) with a penetration depth of 0.5 to one micron, the ratio of thickness to penetration depth is 100–200:1. A ratio of 100–200:1 is significantly better than the 1–2:1 achievable with thin film techniques.

Numerous methods of measuring the penetration depth are available, including muon spin relaxation, DC magnetization, dynamic impedance measurement, and RF stripline resonator temperature dependence calculations. See, Langley, B. W. et al., "Magnetic Penetration Depth Measurements of Superconducting Thin Films by a Microstrip Resonator Technique," *Reviews of Scientific Instruments*, Vol. 62(7), pp. 1801–1812 (1991); Oates, D. E. et al., "Surface Impedance Measurements of $YBa_2Cu_3O_{7-x}$ Thin Films in Stripline Resonators," *IEEE Transactions On Magnetics*, Vol. 27, pp. 867–871 (1991). Because of its application to a wide range of superconductor thicknesses, the dynamic impedance method at 77 K as described in Fiory, A. T. et al., "Penetration Depths of High $T_c$ Films Measured by Two-Coil Mutual Inductances," *Applied Physics Letters*, Vol. 52, pp. 2165–2167 (1988), should be used to measure penetration depth for purposes herein.

The center conductor 22 shown in FIGS. 2 and 3 is not a layer applied directly to either dielectric slab 28 or 30 (as is common with thin film techniques), but is instead a discrete structure which includes a coating 26 formed around the substrate 24. Therefore, the center conductor 22 has two layers of superconductor coating, one on the top and one on the bottom of the substrate 24. (The left and right sides of the substrate are also coated with superconductor, but such coating is only necessary when the substrate 24 is not electrically conductive.) Each layer of coating in the center conductor 22 of the present invention, therefore, is only subjected to magnetic field from one direction, i.e. the top of the center conductor 22 is subjected to fields from the top of the resonator 16, and the bottom of the center conductor 22 is subjected to fields from the bottom of the resonator 16. Thus, when the center conductor 22 is discrete from the dielectric slabs 28 and 30, the stripline resonator of the present invention avoids the halving of the effective thickness of the coating which occurs in thin film stripline resonators. In addition, by forming the center conductor 22 as a part discrete from the dielectric slabs 28 and 30, the resonator of the present invention avoids the possibility of undesirable reaction layers forming between the dielectric slabs and the center conductor.

A center conductor used in a stripline filter of the present invention should have a thickness greater than a thin film layer, i.e., greater than about one micron or, when fields are present on each side of the film, greater than about 0.5 micron on each side of the center conductor. The superconductor in the center conductor used in a stripline filter of the present invention may also have a ratio of thickness to penetration depth which is higher than that for thin film center conductors, i.e., greater than about 4:1 or, when fields are present on each side of the center conductor, greater than about 2:1. If a thick film superconductor has a penetration depth of greater than about 0.5 micron, a 4:1 or 2:1 thickness to penetration depth ratio leads to a superconductor layer thickness of at least about two microns or one micron, respectively.

When ordinary (non-superconducting) conductors are used, engineers commonly design resonators with a ratio of conductor thickness to skin depth of at least about 10:1. Skin depth is the frequency-dependent distance into a conductor at which an external electromagnetic field has decreased in intensity by a factor of e. If a 10:1 ratio of superconductor thickness to penetration depth (which roughly corresponds to skin depth in conductors) is used for the center conductor, where the superconductor has a penetration depth of 0.5 to one micron, a superconductor thickness of at least about five to about ten microns on each side of the substrate 24 may be used. Five to ten microns on each side of substrate 24 leads to a total thickness of at least about ten to twenty microns of superconducting material or a 20:1 ratio of thickness to penetration depth.

Most preferably, the superconductor coating on the center conductor has a thickness of at least about fifty microns on each side of the substrate 24 for a total superconductor thickness of at least about one-hundred microns. If the superconductor has a penetration depth of about 0.5 or about one micron, a fifty-micron coating will have a thickness to penetration depth ratio of about 100:1 or 50:1 respectively.

The foregoing detailed description has been given for clearness of understanding only, and no unnecessary limitations should be understood therefrom, as modifications would be obvious to those skilled in the art.

We claim:

1. A superconducting stripline resonator comprising:

a dielectric element having a first side and a second side;

a first ground plane adjacent the first side of the dielectric element;

a second ground plane adjacent the second side of the dielectric element; and a center conductor located in, but discrete from, the dielectric element, wherein the center conductor is comprised of a thick film of high-temperature superconducting material and the superconducting material has a thickness of at least about one micron.

2. The resonator of claim 1 wherein the dielectric element comprises two dielectric slabs.

3. The resonator of claim 1 wherein:

the dielectric element has a length;

the center conductor has a length; and the length of the center conductor is greater than the length of the dielectric element.

4. The resonator of claim 1 wherein the first ground plane and the second ground plane comprise respective substrates having corresponding coatings of a respective high-temperature superconductor.

5. The resonator of claim 1 wherein:

the center conductor comprises a substrate of the center conductor; and the high-temperature superconducting material is a coating on the substrate.

6. The resonator of claim 5, wherein the coating on the substrate of the center conductor comprises first and second layers coating first and second sides of the substrate of the center conductor, respectively.

7. The resonator of claim 1 wherein:

the center conductor has a first side and a second side;

electromagnetic fields are present on the first side and the second side of the center conductor;

the superconducting material comprises a first layer on the first side of the center conductor and a second layer on the second side of the center conductor;

the first layer has a thickness of at least about 0.5 micron; and the second layer has a thickness of at least about 0.5 micron.

8. The resonator of claim 7 wherein the layers of superconducting material on each side of the center conductor each have a thickness of at least about five microns.

9. The resonator of claim 7 wherein the layers of superconducting material on each side of the center conductor each have a thickness of at least about ten microns.

10. The resonator of claim 7 wherein the layers of superconducting material on each side of the center conductor each have a thickness of at least about fifty microns.

11. The resonator of claim 7 wherein the superconducting material has a penetration depth and the layers of superconducting material on each side of the center conductor each have a thickness at least twice the penetration depth.

12. The resonator of claim 11 wherein the layers of superconducting material on each side of the center conductor each have a thickness of at least about ten times the penetration depth.

13. The resonator of claim 12 wherein the layers of superconducting material on each side of the center conductor each have a thickness of at least about fifty times the penetration depth.

14. The resonator of claim 7 wherein the layers of superconducting material on each side of the center conductor each have a thickness of at least about one micron.

15. The resonator of claim 1 wherein the thickness of the superconducting material is at least about one-hundred microns.

16. The resonator of claim 1 wherein the thickness of the superconducting material is at least about two microns.

17. The resonator of claim 1 wherein the thickness of the superconducting material is at least about ten microns.

18. The resonator of claim 1 wherein the superconducting material has a penetration depth and the thickness of the superconducting material is at least about four times the penetration depth.

19. The resonator of claim 18 wherein the thickness of the superconducting material is at least about one-hundred times the penetration depth.

20. A superconducting stripline resonator comprising:

a dielectric element having a first side and a second side;

a first ground plane adjacent the first side of the dielectric element;

a second ground plane adjacent the second side of the dielectric element; and a center conductor comprised of a high-temperature superconducting material, wherein the center conductor is located in, but discrete from, the dielectric element;

wherein the dielectric element affects electromagnetic fields in the superconducting stripline resonator.

21. The resonator of claim 20 wherein:

the dielectric element has a length;

the center conductor has a length; and the length of the center conductor is greater than the length of the dielectric element.

22. The resonator of claim 20 wherein the first ground plane and the second ground plane comprise respective substrates having corresponding coatings of a respective high-temperature superconductor.

23. The resonator of claim 20 wherein:

the center conductor comprises a substrate of the center conductor; and the high-temperature superconducting material is a coating on the substrate.

24. The resonator of claim 23, wherein the coating on the substrate of the center conductor comprises first and second layers coating first and second sides of the substrate of the center conductor, respectively.

25. The resonator of claim 20 wherein the superconducting material has a thickness of at least about ten microns.

26. The resonator of claim 20 wherein the superconducting material has a thickness of at least about one-hundred microns.

27. The resonator of claim 20 wherein the superconducting material has a penetration depth and the superconducting material has a thickness at least about twice the penetration depth.

28. The resonator of claim 27 wherein the thickness of the superconducting material is at least about four times the penetration depth.

29. The resonator of claim 28 wherein the thickness of the superconducting material is at least about twenty times the penetration depth.

30. The resonator of claim 29 wherein the thickness of the superconducting material is at least about fifty times the penetration depth.

31. The resonator of claim 30 wherein the thickness of the superconducting material is at least about one-hundred times the penetration depth.

32. The resonator of claim 20 wherein the superconducting material has a thickness of at least about two microns.

33. The resonator of claim 20 wherein the dielectric element comprises two dielectric slabs.

34. A superconducting stripline resonator comprising:

a dielectric element having a first side and a second side;

a first ground plane adjacent the first side of the dielectric element;

a second ground plane adjacent the second side of the dielectric element; and a center conductor located in, but discrete from, the dielectric element and comprised of a high-temperature superconducting material;

wherein the superconducting material has an electromagnetic field penetration depth and the superconducting material has a thickness which is at least twice the penetration depth.

35. The resonator of claim 34 wherein the first ground plane and the second ground plane comprise substrates of the first ground plane and the second ground plane having respective coatings of high-temperature superconductor.

36. The resonator of claim 34 wherein:

the center conductor comprises a substrate; and the high-temperature superconducting material is a coating on the substrate of the center conductor.

37. The resonator of claim 36, wherein the coating on the substrate of the center conductor comprises first and second layers coating first and second sides of the substrate of the center conductor, respectively.

38. The resonator of claim 34 wherein the thickness of the superconducting material is at least about twenty times the penetration depth.

39. The resonator of claim 34 wherein the thickness of the superconducting material is at least about fifty times the penetration depth.

40. The resonator of claim 34 wherein the thickness of the superconducting material is at least about one-hundred times the penetration depth.

41. The resonator of claim 34 wherein the thickness of the superconducting material is at least about two microns.

42. The resonator of claim 34 wherein:

the dielectric element has a length;

the center conductor has a length; and the length of the center conductor is greater than the length of the dielectric element.

43. The resonator of claim 34 wherein the dielectric element comprises two dielectric slabs.

44. A superconducting stripline resonator comprising:

a dielectric element having a first side and a second side;

a first ground plane adjacent the first side of the dielectric element;

a second ground plane adjacent the second side of the dielectric element; and a center conductor located in the dielectric element and comprised of a high-temperature superconducting material;

wherein the dielectric element has a length, the center conductor has a length, and the length of the center conductor is greater than the length of the dielectric element such that the center conductor extends beyond the dielectric element.

45. The resonator of claim 44 wherein the superconducting material has a thickness of at least about two microns.

46. The resonator of claim 44 wherein;

the superconducting material has a thickness;

the superconducting material has a penetration depth; and the thickness of the superconducting material is at least about twenty times the penetration depth.

47. The resonator of claim 44 wherein the dielectric element comprises two dielectric slabs.

48. The resonator of claim 44 wherein the first ground plane and the second ground plane comprise respective substrates having corresponding coatings of a respective high-temperature superconductor.

49. The resonator of claim 44 wherein:

the center conductor comprises a substrate of the center conductor; and the high-temperature superconducting material is a coating on the substrate.

50. The resonator of claim 49, wherein the coating on the substrate of the center conductor comprises first and second layers coating first and second sides of the substrate of the center conductor, respectively.

51. A superconducting stripline resonator comprising:

a dielectric element having a first side and a second side;

a first ground plane adjacent the first side of the dielectric element;

a second ground plane adjacent the second side of the dielectric element; and a center conductor located in, but discrete from, the dielectric element and comprised of a high-temperature superconducting material;

wherein the dielectric element has a length, the center conductor has a length, and the length of the center conductor is greater than the length of the dielectric element.

* * * * *